United States Patent [19]

Schoenig

[11] 4,415,163

[45] Nov. 15, 1983

[54] PORTABLE VOLLEYBALL APPARATUS

[76] Inventor: Darrell A. Schoenig, 432 Clover La., Ft. Collins, Colo. 80521

[21] Appl. No.: 351,254

[22] Filed: Feb. 22, 1982

[51] Int. Cl.[3] ..... A63B 61/04; A63B 71/02

[52] U.S. Cl. ..... 273/411; 273/29 BC

[58] Field of Search ..... 273/411, 29 B, 29 BA, 273/29 BC, 29 BD, 29 BE, 29 BF

[56] References Cited

U.S. PATENT DOCUMENTS 1,546,271 7/1925 Wattenbarger ..... 273/29 B 4,022,471 5/1977 Keller ..... 273/411

FOREIGN PATENT DOCUMENTS 1015722 10/1952 France ..... 273/411

*Primary Examiner*—William H. Grieb

*Attorney, Agent, or Firm*—Hugh H. Drake

[57] ABSTRACT

A pair of spaced poles are each telescopically adjustable in height and include respective clamps lockable to fix that heighth. A net has side margins and top margins. A rope secured to the top margin is securable between the tops of the poles. A first pair of ties are secured individually at one end to an upper portion of the side margin and are secured individually at the other end to a corresponding upper end of a respective one of the poles. A second pair of ties similarly are secured individually at one end to the other side margin and to the corresponding intermediate portion of a respective pole. All ties are secured in a manner as to induce resilient tension therein. A plurality of lines each are selectively adjustable in length, respective pairs of those lines diverging downwardly and outwardly from the top of corresponding ones of the poles into securement with an underlying substrate.

2 Claims, 8 Drawing Figures

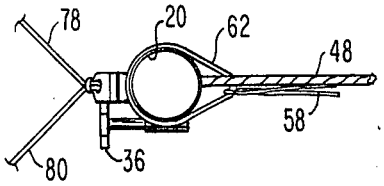
FIG. 4
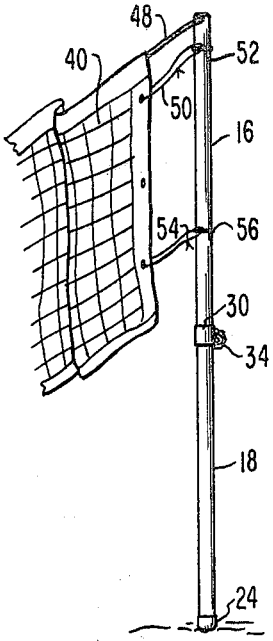
FIG. 6
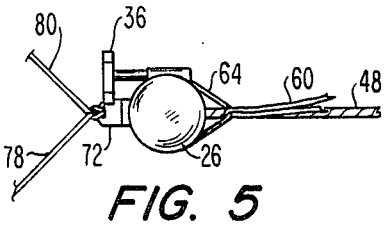
FIG. 5
FIG. 8
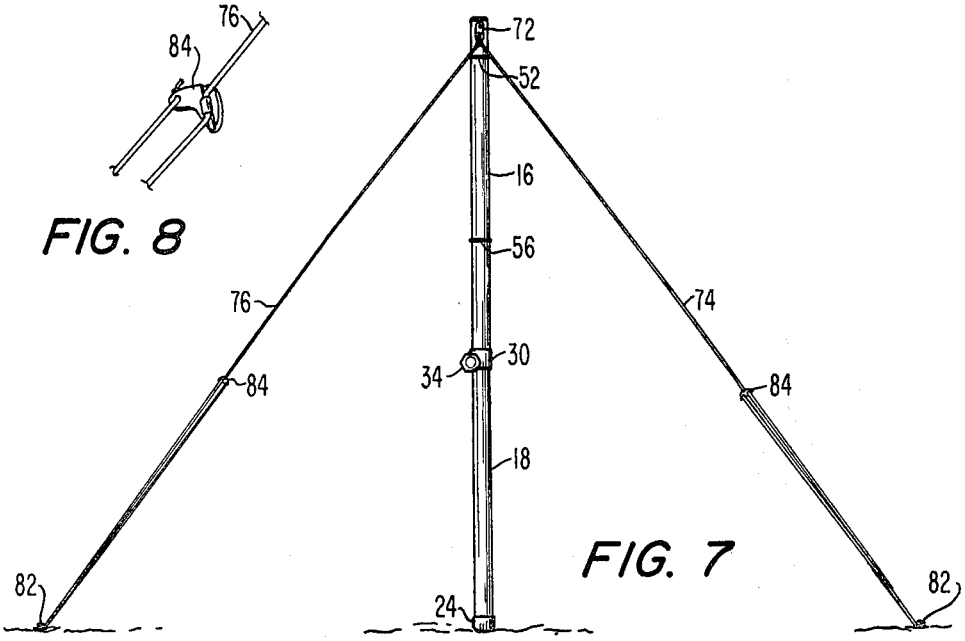
FIG. 7

PORTABLE VOLLEYBALL APPARATUS

The present invention relates to a portable volleyball apparatus. More particularly, it pertains to a set of apparatus components which, when assembled, constitute a net assembly for the game of volleyball.

The game of volleyball involves the suspension of a stretched net at an elevated level. For suspending the net, the typical apparatus used in a gymnasium or the like involves a pair of upright posts each of which is anchored in a heavy base that sits on the floor. Vertically spaced hooks along the side of each of the posts permit attachment of the intervening net. The net is stretched by pulling one post apart from the other.

It has become popular to enjoy the game of volleyball in the outdoors. Whether the net is situtated in the backyard, a park or elsewhere, it has become desirable to provide portable apparatus. This dictates against use of the sturdy posts and heavy bases of gymnasium-type apparatus.

When such portable apparatus is assembled, nevertheless, it must be erected in a manner that stretches the net in a taut manner and which exhibits sufficient strength to avoid collapse of the assembly when the net is impinged against by the body of an individual player. Prior portable apparatus of this sort has been found to be deficient in the accommodation of uneven terrain, in ease of set up and in the maintenance of a taut and sturdy net.

It is, accordingly, a general object of the present invention to provide a new and improved volleyball apparatus which overcomes such deficiencies.

A further object of the present invention is to provide a portable volleyball apparatus that is economical of construction and yet which achieves that main objective.

In accordance with the present invention, a portable volleyball apparatus has a pair of space-opposable poles each composed of a pair of mutually-telescopic tubes. A pair of adjustable clamps individually are disposed on respective ones of those poles in a position to enable locking of telescopic extension. A rectangular net has space-opposed side margins and a top margin. A rope is secured to a top margin and is securable between the tops of the poles. A first pair of ties are each secured individually at one end to an upper portion of a corresponding side margin and are secured individually at the other end to a corresponding upper end of a respective pole. A second pair of ties are each secured individually at one end to a lower portion of a corresponding side margin and are each secured individually at the other end to a corresponding intermediate portion of a respective one of the poles. All ties are so secured in a manner as to induce a resilient tension therein. A plurality of lines each are of selectively adjustable length, and respective pairs of those lines diverge downwardly and outwardly from the top of corresponding ones of the poles and into securement with the substrate upon which the lower ends of the poles are placed.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

FIG. 4 is a fragmentary top plan view of a portion of FIG. 2;

FIG. 5 is a fragmentary bottom plan view of the portion shown in FIG. 4;

FIG. 6 is a fragmentary front elevational view of that which is shown in FIG. 3 but with certain of the parts somewhat collapsed in tension;

FIG. 7 is an end elevational view of the assembly of FIG. 1; and

FIG. 8 is an enlarged fragmentary elevational view of a component shown in FIG. 2.

Figure 1:
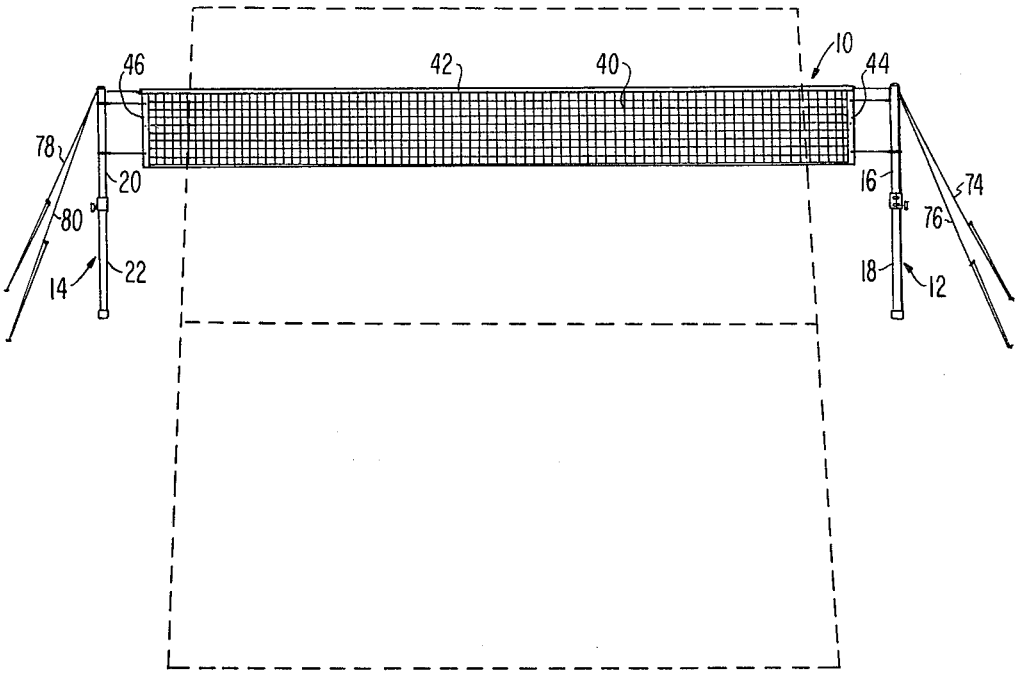
FIG. 1 is an isometric view of a volleyball apparatus installed upon a substrate and over a playing area designated by dashed lines.
Figure 2:
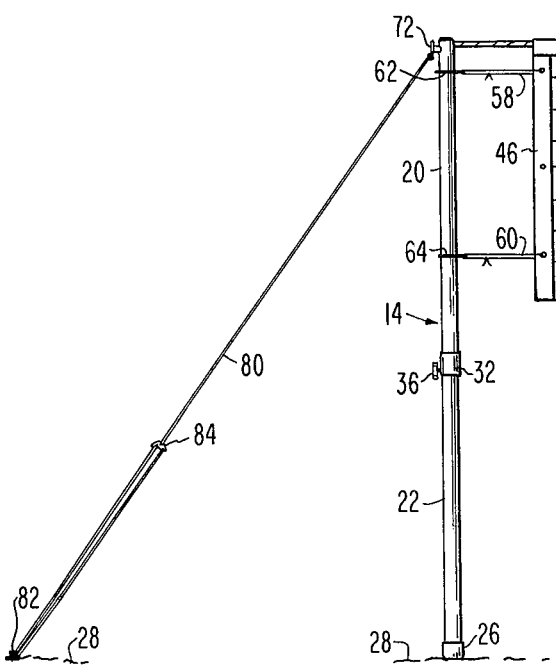
FIG. 2 is a fragmentary enlarged front elevational view of a left-end portion thereof.
Figure 3:
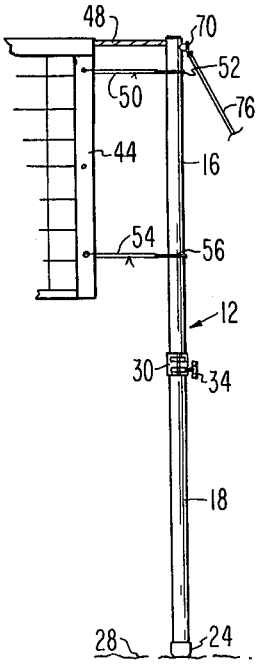
FIG. 3 is a view similar to FIG. 2 but of a right-end portion thereof.

A portable volleyball apparatus 10 includes a pair of space opposed poles 12 and 14. Each pole 12 and 14 includes a pair of mutually telescopable mating tubes 16 and 18 and 20 and 22, respectively. In this case, the bottom ends of each of tubes 18 and 22 are seated in respective cups 24 and 26 which, in use, rest upon a substrate 28.

At the juncture of all of the tubes are respective ones of a pair of adjustable clamps 30 and 32. Each of clamps 30 and 32 is a split collar into which is threaded one of respective handknobs 34 and 36 for tighting the collars about the tubes and, thus, clamping the tubes at a desired degree of telescopic extension.

Stretched between poles 12 and 14 is a standard volleyball net 40. It features the usual woven mesh and also has a hemmed top margin 42 and somewhat stiff side margins 44 and 46. A rope 48 is fed through the hem of top margin 42 and is secured at its opposite ends to the tops of poles 12 and 14.

A tie 50 is secured individually at one end to an upper portion of side margin 44 and at its other end to a rubber collar 52 which is ensleeved upon and thus encircles the upper end of tube 16 of pole 12. Another tie 54 is secured at one end to a lower portion of margin 44 and at its other end to another rubber collar 56 on tube 16. Similarly secured to the other side margin 46 are ties 58 and 60 which connect to respective rubber collars 62 and 64.

Secured on the outer side and at the upper end of each of poles 12 and 14, specifically on tubes 16 and 20, are respective cleats 70 and 72. Lines 74 and 76 diverge downwardly and outwardly from cleat 70. Similar lines 78 and 80 diverge downwardly and outwardly from cleat 72 at the top of pole 14. Each of lines 74–80 is connected to a respective stake 82 which has been driven into the underlying surface or substrate 28 which, in the environment intended, is simply the ground. Each line is wrapped through a hook on a stake 82 and returned back upon itself to a friction lock 84.

Normally, the apparatus when not in use is stored in a box with the poles spaced close together and with the net wrapped therearound. To set up the net, the user spreads out the net on the ground. Pole 12 is then set into an upright position, while its lines 74 and 76 are attached to stakes 82 which have been driven into the ground. The same thing is then done with regard to pole 14 and its lines 78 and 80. Pulling up upon the friction locks stretches rope 48 tight. At this point, poles 12 and 14 may be slightly shifted in or out at their bottom ends to obtain a vertical orientation. Just in obtaining that orientation and the necessary tightness of rope 48, ties 50, 54, 58 and 60 become taut, stretching their respective rubber collars 52, 56, 62 and 64 as indicated in FIGS. 4 and 5. Thus, net 40 automatically becomes taut as a result of the mirror set up of the overall assembly. That is, the rubber collars induce resilient tension in each of those ties that maintain the desired shape and taut condition of the net. Any necessary final adjustment is made by manipulation of clamps 30 and 32 to tighten the assembly in the upper direction to the proper height while "fine-tuning" the adjustment on the diverging side lines by means of frictional locks 84. During such manipulation, the ties extending from the side margins and the tension induced in the rubber collars insure that the net is in its upright and taught condition.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. A portable volleyball apparatus comprising:

a pair of space-opposable poles each composed of a pair of mutually-telescopable tubes;

a pair of adjustable clamps individually disposed on respective ones of said poles in a position to enable locking of said tubes of each pair thereof at a desired degree of telescopic extension;

a rectangular, elongated net having space-opposed side margins and a top margin;

a rope secured to said top margin and securable between the tops of said poles;

a first pair of ties each secured individually at one end to an upper portion of a corresponding side margin and each secured individually at its other end to a corresponding upper end of a respective one of said poles, said ties being so secured as to induce resilient tension in said ties;

a second pair of ties each secured individually at one end to a lower portion of a corresponding side margin and each secured individually at its other end to a corresponding intermediate portion of a respective one of said poles, said second pair of ties also being so secured as to induce resilient tension therein;

and a plurality of lines each of selectively adjustable length, respective pairs of said lines diverging downwardly and outwardly from the top of corresponding ones of said poles into securement with a substrate upon which the lower ends of said poles are placed.

2. Apparatus as defined in claim 1 which includes respective pairs of vertically spaced rubber collars ensleeved on corresponding ones of said poles, individual ones of said ties being secured to respective ones of said collars and said collars imparting said resilient tension.

* * * * *